US008635720B2

(12) United States Patent
Aabakken

(10) Patent No.: US 8,635,720 B2
(45) Date of Patent: Jan. 28, 2014

(54) PATIENT LIFTING SYSTEM

(75) Inventor: Skjalg Aabakken, Oslo (NO)

(73) Assignee: Integra International AS, Oslo (NO)

( * ) Notice: Subject to any disclaimer, the term of this patent is extended or adjusted under 35 U.S.C. 154(b) by 28 days.

(21) Appl. No.: 13/319,702

(22) PCT Filed: Apr. 30, 2010

(86) PCT No.: PCT/NO2010/000160

§ 371 (c)(1),
(2), (4) Date: Dec. 7, 2011

(87) PCT Pub. No.: WO2010/131974

PCT Pub. Date: Nov. 18, 2010

(65) Prior Publication Data

US 2012/0090090 A1 Apr. 19, 2012

(30) Foreign Application Priority Data

May 15, 2009 (NO) ..... 20091908

(51) Int. Cl.
*A61G 7/10* (2006.01)
*A61G 7/14* (2006.01)

(52) U.S. Cl.
USPC ..... 5/87.1; 5/83.1; 5/85.1

(58) Field of Classification Search
USPC ..... 5/81.1 R, 83.1–85.1, 87.1, 89.1; 212/230, 233
See application file for complete search history.

(56) References Cited

U.S. PATENT DOCUMENTS 5,005,233 A * 4/1991 Toivio et al. ..... 5/83.1
5,018,933 A * 5/1991 Kramer ..... 414/542
5,239,713 A * 8/1993 Toivio et al. ..... 5/87.1
5,682,630 A * 11/1997 Simon ..... 5/87.1
5,878,536 A 3/1999 Demmitt et al.
7,178,181 B1 2/2007 Fulmer
8,250,686 B2 * 8/2012 Minning et al. ..... 5/85.1
8,336,138 B2 * 12/2012 Newkirk et al. ..... 5/600
2004/0199996 A1 10/2004 Newkirk et al.
2005/0097670 A1 5/2005 Hawk et al.
2007/0067911 A1 3/2007 Graham et al.
2012/0090090 A1 * 4/2012 Aabakken ..... 5/87.1

FOREIGN PATENT DOCUMENTS

CN 2093625 U 1/1992
CN 2586468 Y 11/2003
GB 2446569 A 8/2008

OTHER PUBLICATIONS

International Search Report.

* cited by examiner

*Primary Examiner* — Michael Trettel
(74) *Attorney, Agent, or Firm* — Harness, Dickey & Pierce P.L.C.

(57) ABSTRACT

A system is disclosed for handling and moving bedridden or mobility impaired patients. In at least one embodiment, the system includes a vertical arm that is arranged in a vertical cabinet, which vertical arm is connected to an arm that is pivotal in a horizontal plane arranged in a horizontal overhead cabinet, the arms being adjustable from an inactive and secured position arranged in the cabinets to an active position arranged outside the cabinets. The horizontal overhead cabinet is connected to the arm that is pivotal in a horizontal plane, and follows the movement of the arm from an inactive and secured position to an active position. A drive unit is further connected to the arm that is pivotal in a horizontal plane, which drive unit via at least a wire or the like is connected to a removable lifting bar. In an inactive and secured position of the system for handling and moving bedridden patients or mobility impaired persons, the horizontal overhead cabinet will house the arm.

20 Claims, 8 Drawing Sheets

PATIENT LIFTING SYSTEM

Example embodiments relate to an integral system for handling and moving bedridden patients or mobility impaired persons, and more specifically example embodiments relate to integration of a patient lifting apparatus for patients or mobility impaired persons into a piece of furniture.

BACKGROUND

The handling and moving of bedridden patients or mobility impaired persons will often be time-consuming and challenging both for the recipient of such handling and for the person or persons who are to perform the handling and/or moving or transfer. To be able to handle the patient or person optimally, the equipment used during this handling or moving is therefore very often arranged in proximity to the patient or the mobility impaired person.

It is known that equipment for handling and moving bedridden patients or mobility impaired persons is constituted of various lifting devices that are designed to move the patient or person, where these lifting devices may be attached to rails in the ceiling or may be freely movable ("floor travelling"). Various aids are also used in connection with the lifting devices in order to be able to carry out the different tasks, such as lifting slings, lifting straps, patient lift sheets etc.

U.S. Pat. No. 5,878,536, US 2004/0199996 and US 2007/0067911 make known different systems for use in hospitals or similar institutions, where the systems are used in connection with the handling and moving of patients. The systems comprise one or more pivotal arms, to which arms different medical equipment may be connected. The medical equipment may be equipment for monitoring heart/lung function etc., infusion pump(s), defibrillators etc. The use of pivotal arms will allow the equipment that is connected to the arm(s) to be positioned close to the patient. The pivotal arms may also be configured as a lifting device, with the aid of which the patients can be lifted or moved. The known systems are also of such character that either the room in which the systems are to be disposed must be altered or modified before the systems can be installed in the room, or the systems will be of such a character that they take up large parts of the room's floor space.

The aforementioned systems and equipment will, however, be of such character that they are only partly capable of being stowed or put away after use, which means that they will constantly take up a greater or smaller part of the room's floor space. Even more important, however, is that the known solutions will be a nuisance and/or be seen as unworthy for a patient or a mobility impaired person, especially if the equipment is used at the home of the patient or the mobility impaired person.

Furthermore, the systems and equipment according to the known solutions might injure the patient and/or their caregivers, as the equipment between times of use is not secured and out of the area of movement of the caregiver and/or patient. For the same reason, the equipment may also be damaged or rendered ineffective.

The known solutions also comprise loose components that are used during the handling and moving of the patient or the mobility impaired person, for example, lifting bars, lifting slings etc., which easily become misplaced after use.

If the known solutions are to be used in a private home, they will often require extensive installation work and/or alteration of one or more rooms, which often is not desirable.

SUMMARY

An object of the present invention will therefore be to provide an integral system for handling and moving bedridden patients or mobility impaired persons, wherein the integral system according to the present invention allows the equipment, in a simple and uncomplicated manner, to be stowed away and secured after use, and where the appearance of the room is almost unchanged after installation of the system.

A further object of the present invention will be to provide a system for handling and moving bedridden patients or mobility impaired persons, which is integrated into a piece of furniture.

Another object of the present invention will be to provide a system for handling and moving bedridden patients or mobility impaired persons, which system after use can be stowed away and secured in a piece of furniture.

Yet another object of the present invention will be to provide a system for handling and moving bedridden patients or mobility impaired persons, which system can be installed in small rooms and/or in rooms with limited load-bearing capacity in walls and/or ceiling.

A further object of the present invention will be to provide a system for handling and moving bedridden patients or mobility impaired persons, where the patient or the mobility impaired person is to a far greater extent able to utilise the system themselves.

These objects are achieved with an integral system for handling and moving bedridden patients or mobility impaired persons according to the following independent claim, with additional embodiments set forth in the dependent claims.

According to the present invention there is provided an integral system for handling and moving bedridden patients or mobility impaired persons, where a piece of furniture consisting of at least a vertical cabinet and a horizontal cabinet disposed thereabove houses a patient lifting apparatus. In a preferred embodiment of the present invention, the vertical cabinet will be fixed to a wall, for example, to a wall of a bedroom, but the vertical cabinet may also be configured as a "free-standing and movable" cabinet with legs, lockable wheels, etc., such that it can simply be placed against the wall.

The patient lifting apparatus comprises a vertical arm, which in a suitable manner is connected to an arm pivotal in a horizontal plane. The pivotal horizontal arm is connected to the vertical arm so as to allow the pivotal horizontal arm to be turned about an axis that extends in the longitudinal direction of the vertical arm. The connection between the vertical arm and the arm that is pivotal in a horizontal plane may, for example, be formed of a hinge device, pivot support or the like.

The vertical arm is preferably of such a length that it will extend a substantial distance from the floor and up along the wall that it is arranged adjacent to. Alternatively, the vertical arm may extend between the floor and ceiling of the room. The vertical arm may, however, also be of such character that it will function as a "mounting bracket" for the arm that is pivotal in a horizontal plane, the vertical arm in this instance being short. In such cases it is also conceivable that the vertical cabinet can be recessed into or in some other way partly hidden in or replaced by the room's wall. How the vertical arm is to be configured will depend on the load to which the system for handling and moving bedridden patients or mobility impaired persons is subjected, mounting possibilities, the mounting surface etc., and here one of skill in the art will know how this is to be done.

In a preferred embodiment of the present invention, the arm that is pivotal in a horizontal plane is formed of two members that are pivotally connected to each other in a suitable manner. However, it should be understood that the articulated arm may comprise more than two members. One or more of the arm members may also be telescopic.

The arm that is pivotal in a horizontal plane may also be constituted of one member, which member may in addition be telescopic.

The connection between the different members of the arm that is pivotal in a horizontal plane may, for example, be constituted of a hinge device, a pivot support or the like.

The vertical and the horizontal arm preferably have a square cross-sectional profile, but other cross-sectional profiles may also be used, for example, a rectangular, circular or oval cross-sectional profile. Furthermore, the vertical and the horizontal arm need not have the same cross-sectional profile.

Since by means of the present invention it is desired that the system should be capable of being moved from a stowed-away and secured position to an active position and then back into the stowed-away and secured position after use as intuitively and easily as possible, the horizontally disposed overhead cabinet will, in a suitable manner, be connected to one member of the articulated arm that is pivotal in a horizontal plane, such that the articulated arm will follow the movement of the horizontally disposed overhead cabinet.

When the system for handling and moving bedridden patients or mobility impaired persons is not in use, the horizontally disposed overhead cabinet will be arranged adjacent to the wall against which the system is arranged. The horizontally disposed overhead cabinet will then house and secure the articulated arm, whereby also the articulated arm will be arranged adjacent to the wall. When the system is to be used to handle or move a bedridden patient or a mobility impaired person, a caregiver will, by means of a handle or the like provided on the horizontally disposed overhead cabinet, pull the horizontally disposed overhead cabinet out from the wall, whereby the articulated arm will follow the movement of the horizontally disposed overhead cabinet, and the horizontally disposed overhead cabinet will then be positioned above the bedridden patient or the mobility impaired person. The system is now ready to lift and/or move the bedridden patient or the mobility impaired person. After use, the above procedure will be repeated in the reverse order, whereby the horizontally disposed overhead cabinet is brought into a position adjacent to the wall against which the system is arranged. Thus, the system according to the present invention provides a patient lifting apparatus which can be brought from a stowed-away and secured position into a position for use in one and the same integrated movement.

In an alternative embodiment of the present invention, the vertical arm may also be pivotally mounted, such that it will follow the rotational movement of the articulated arm.

The vertical arm of the patient lifting apparatus, in a preferred embodiment of the present invention, will be fastened to the room wall, internally in the vertical cabinet. Alternatively, the vertical arm can also be fastened to an inner surface of the vertical cabinet. Mounting can be effected using screws, bolts, mounting brackets, fixing plates, etc.

It should be understood, however, that the vertical arm of the patient lifting apparatus need not be affixed to a wall or internally in the vertical cabinet, but may, for example, also be affixed to the ceiling and floor of the room, to a wall and ceiling or to a wall and floor. The vertical arm will, however, run through the vertical cabinet.

In a preferred embodiment of the present invention, the patient lifting apparatus is constituted only of the vertical arm which is connected to the articulated arm that is pivotal in a horizontal plane. The patient lifting apparatus may, however, also comprise one or more support legs, in particular if the patient lifting apparatus is to be subjected to great loads and/or that the mounting surface (plasterboard, wooden walls etc.) has a limited load-bearing capacity.

The vertical arm of the patient lifting apparatus will then be equipped with one or more support legs, this or these support legs in a preferred embodiment of the invention being affixed to the room's wall and/or floor.

It should also be understood that the support leg or legs need not be affixed to a wall and/or floor, which will allow them to be brought out into a supporting position, so as to "reduce the load" on the patient lifting apparatus.

If the patient lifting apparatus is equipped with support legs, the support leg or legs may be arranged so as to be freely pivotal, for example, through a hinge arrangement, a pivot bearing or the like, such that they can be moved out into a supporting position when the patient lifting apparatus is loaded, and moved back into an inactive position when the patient lifting apparatus is not in use.

Alternatively, the support leg or legs used to support the patient lifting apparatus can be affixed to a wall and/or floor, either independently or with the aid of support plates/mounting brackets, whereby the system takes up a minimum of free floor space. This will be preferable in particular in small/confined rooms. The support leg or legs will then be arranged so as to extend under a bed, adjacent to which bed the system for handling and moving bedridden patients or mobility impaired persons is arranged.

The articulated arm that is pivotal in a horizontal plane is, in a first embodiment of the present invention, constituted of two members that are pivotally connected to each other. One of the members of the pivotal arm may, in an alternative embodiment of the present invention, also be telescopic, thereby allowing the "working range" of the patient lifting apparatus to be increased.

The patient lifting apparatus is preferably operated manually by a person, for example, a caregiver or the like, but may also conceivably be operated with the aid of "remote control" or the like.

The patient lifting apparatus also comprises a lifting device for the patient or the mobility impaired person, the lifting device comprising a drive unit for a cable, belt or a wire that is used to lift and move the patient or the mobility impaired person. With the aid of the drive unit, the cable, belt or wire can be paid out or drawn in. One end of the cable, belt or wire comprises a hook, quick release coupling or the like, so that, for example, a removable lifting bar can be connected to the cable, belt or wire. When moving a patient or a mobility impaired person, the articulated arm that is pivotal in a horizontal plane will, by "manoeuvring" the horizontally disposed overhead cabinet, first be brought into a position above the bedridden person, whereafter the lifting device, with the aid of the drive unit will be lowered towards the patient or the mobility impaired person. The hook, rapid release coupling or the like will then, either directly or via a lifting bar, be connected to a lifting sling, a lift sheet or the like, on which the patient or the mobility impaired person is placed, after which a caregiver will operate a remote control that is connected to the drive unit, such that the patient or the mobility impaired person is lifted up from a bed, chair etc. The lifting sling or lift sheet will then be configured with lifting lugs, hooks, rapid release couplings or the like.

When the patient or the mobility impaired person has been lifted up from the bed or the chair, the articulated arm that is pivotal in a horizontal plane is used, by "manoeuvring" the horizontally disposed overhead cabinet, in order to transfer the patient or the mobility impaired person to the chair or the bed, whereupon a "reverse" procedure is carried out to lower the patient or person.

In a preferred embodiment of the present invention, the drive unit is fixedly connected to the articulated arm or to the inside of the horizontally disposed overhead cabinet, but may also conceivably be so arranged that the drive unit can be moved in the longitudinal direction of the articulated arm or the overhead cabinet.

The drive unit may in a preferred embodiment of the present invention be constituted of a motor, gear and motor brake, which are connected directly to a drum. The drive unit may furthermore be permanently connected to a mains supply. In this case a power cable, which is connected to the drive unit, can be run along the arm that is pivotal in a horizontal plane and the vertical arm, whereafter it is connected to the mains supply. Alternatively, the drive unit will also comprise one or more "backup" batteries, where these will automatically supply power in the event of a power failure etc.

If the system for handling and moving bedridden patients or mobility impaired persons is provided so that it can be controlled with the aid of a control unit/control panel, where this can be done by means of remote control or by using cable, the patient or the mobility impaired person will to a far greater extent also be able to use the system themselves.

BRIEF DESCRIPTION OF THE DRAWINGS

Other advantages and characteristics of the present invention will be apparent from the following detailed description, the appended drawings and the following claims, wherein

DETAILED DESCRIPTION OF EXAMPLE EMBODIMENTS

Figure 1A:
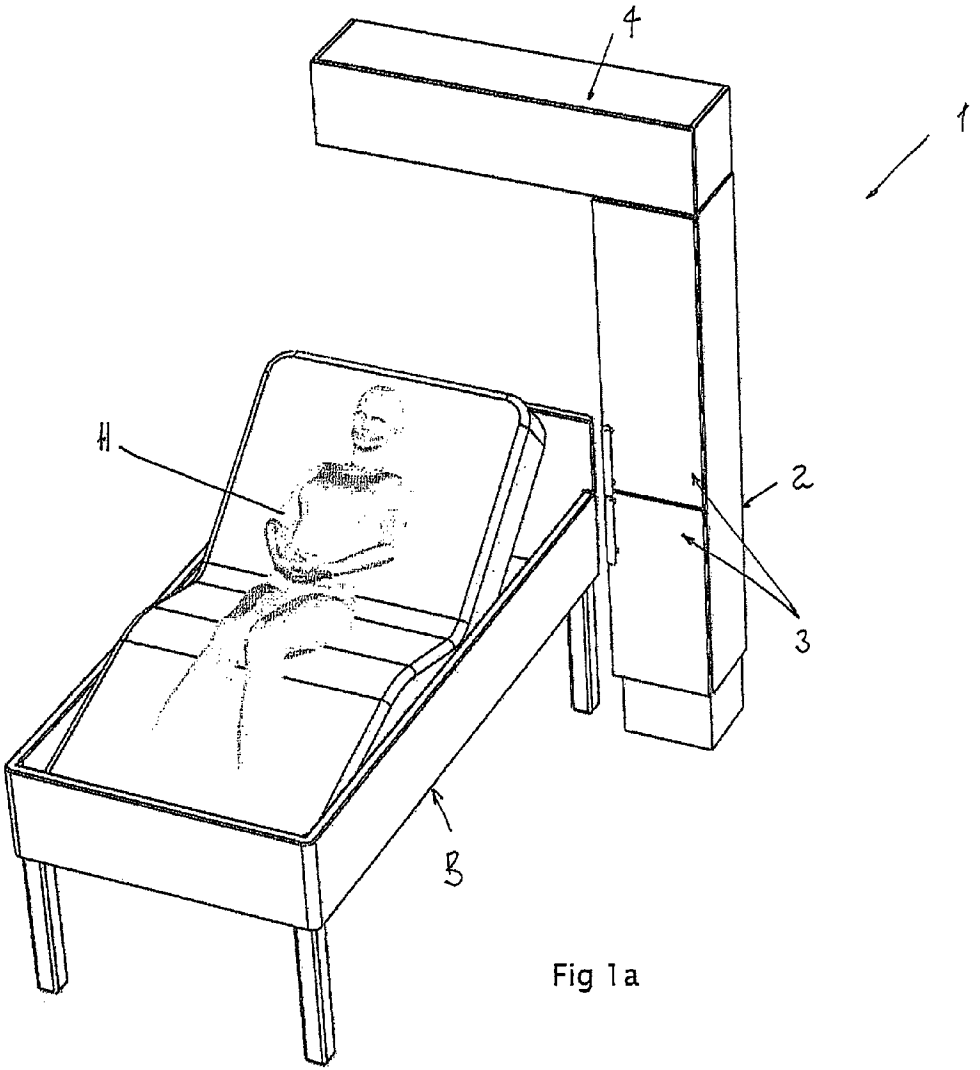
FIGS. 1*a-d* show a perspective view of a system for handling and moving bedridden patients or mobility impaired persons according to the present invention.
Figure 1B:
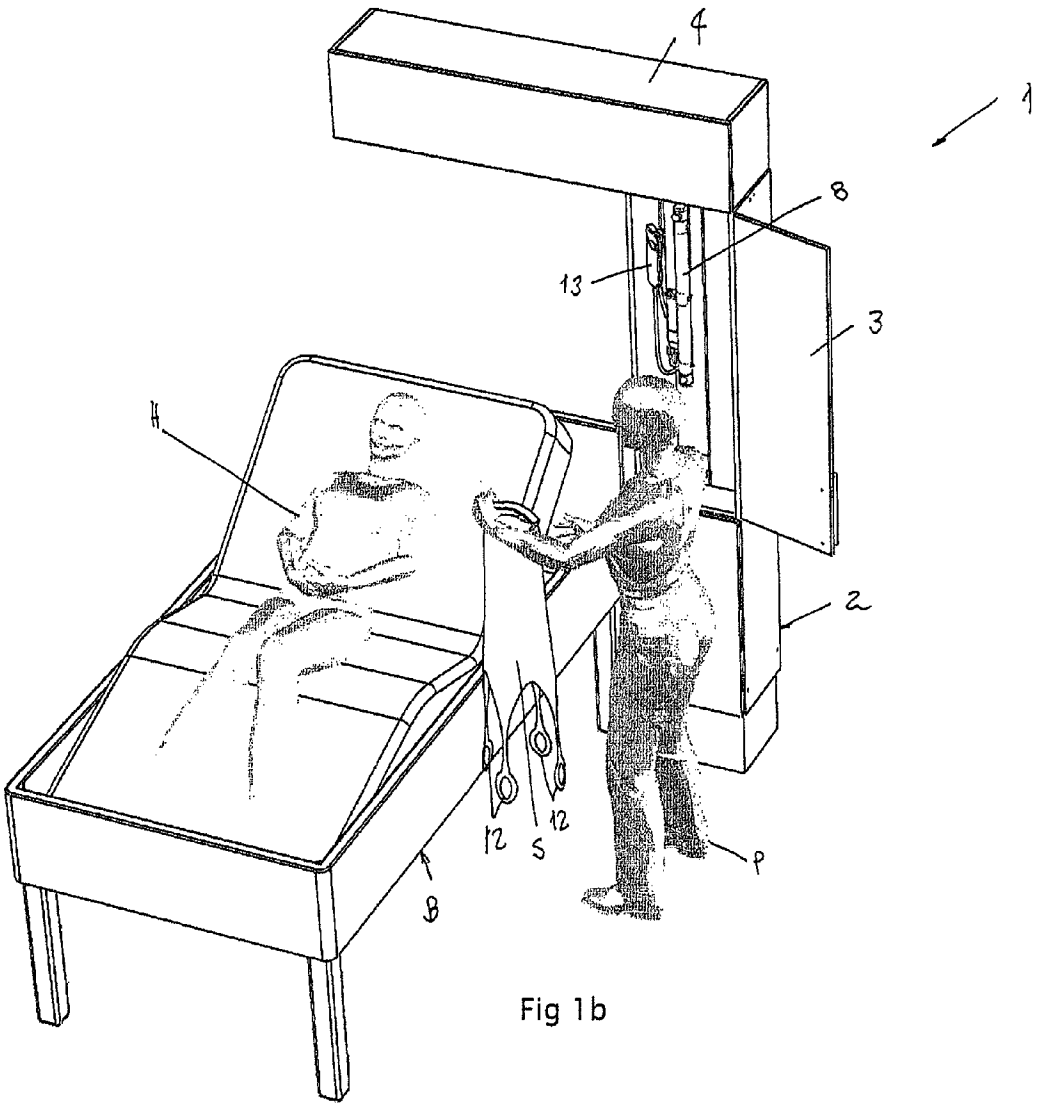
Figure 1C:
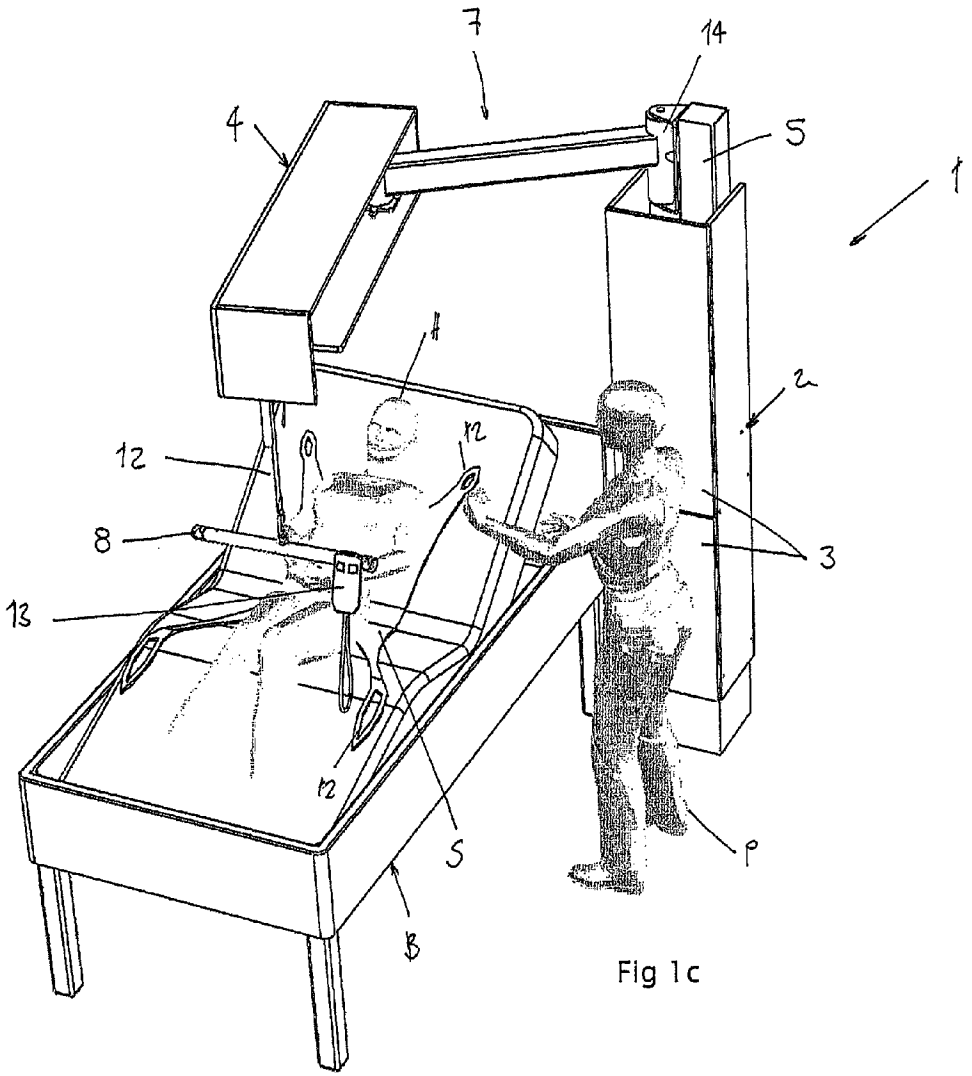
Figure 1D:
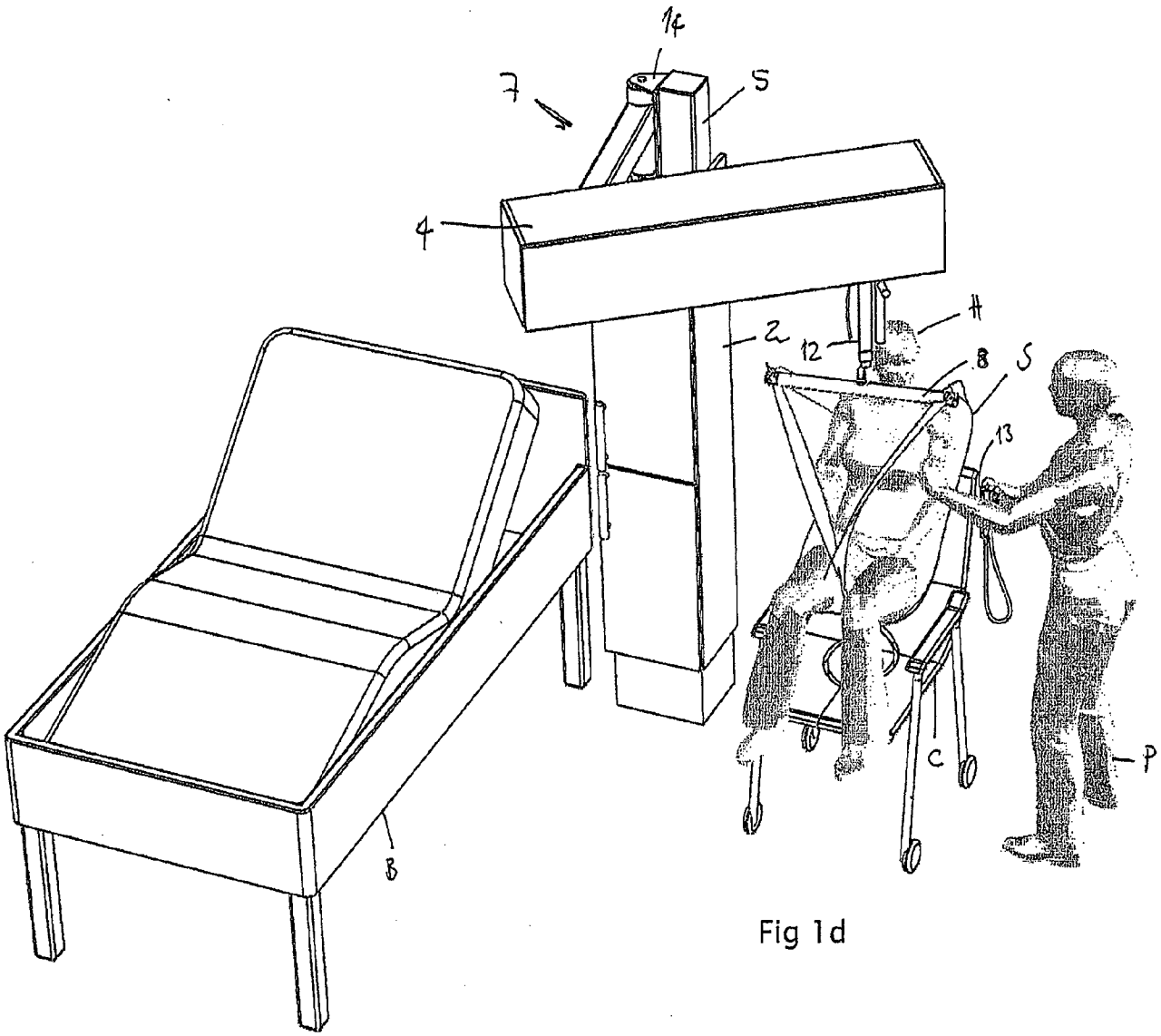

FIGS. 1*a-d* show an integral system for handling and moving a bedridden patient or a mobility impaired person H. FIG. 1*a* shows the system 1 installed in a room, for example, in the patient's or the mobility impaired person's H own house, arranged in proximity to a bed. The system 1 is shown in a retracted and secured position. FIG. 1*b* shows a caregiver P who is in the process of preparing the system 1 for use. FIG. 1*c* shows that a bedridden patient or a mobility impaired person H is placed on a lifting sling S and is thus ready to be transferred from a bed B to a chair C, and FIG. 1*d* shows the patient or the person H who is in the process of being lowered into the chair with the aid of the system 1.

In FIG. 1*a* it can be seen that the system for handling and moving bedridden patients or mobility impaired persons 1 is arranged in a retracted and secured position, the system 1 comprising a vertical cabinet 2, which in a suitable way is fastened to a wall (not shown) in, for example, a bedroom. The vertical cabinet 2 comprises two doors 3 and may also include a number of shelves. Disposed above the vertical cabinet 2 is a horizontal cabinet 4. A vertical arm 5 (see also FIG. 1*c*) of a patient lifting apparatus (person lifter) is arranged in the vertical cabinet 2, which vertical arm 5 may be fastened to the vertical cabinet 2 internally therein, or also to a wall, floor and/or ceiling (not shown). A bed B is also arranged adjacent to the system 1.

Figure 3A:
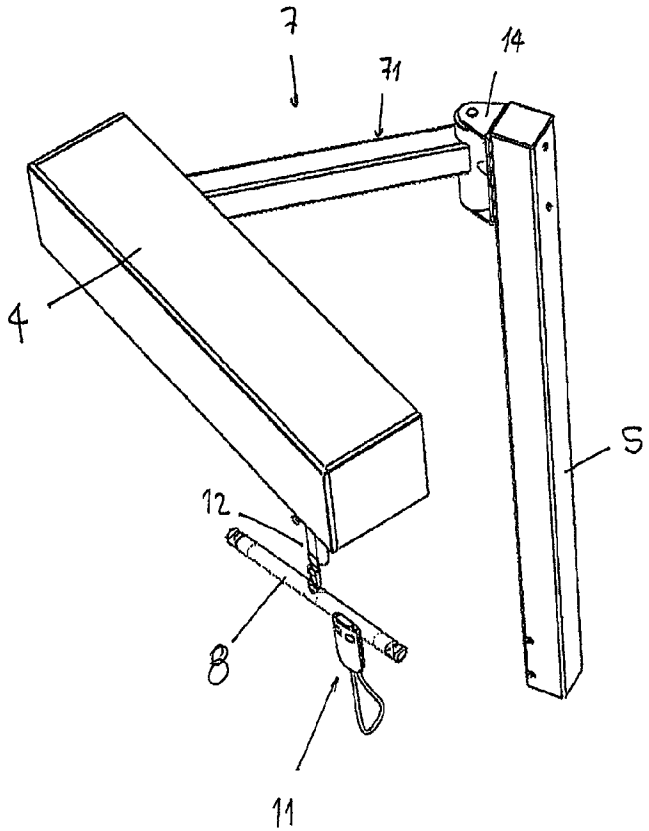
FIGS. 3*a-b* show details of the patient lifting apparatus according to the present invention.
Figure 3B:
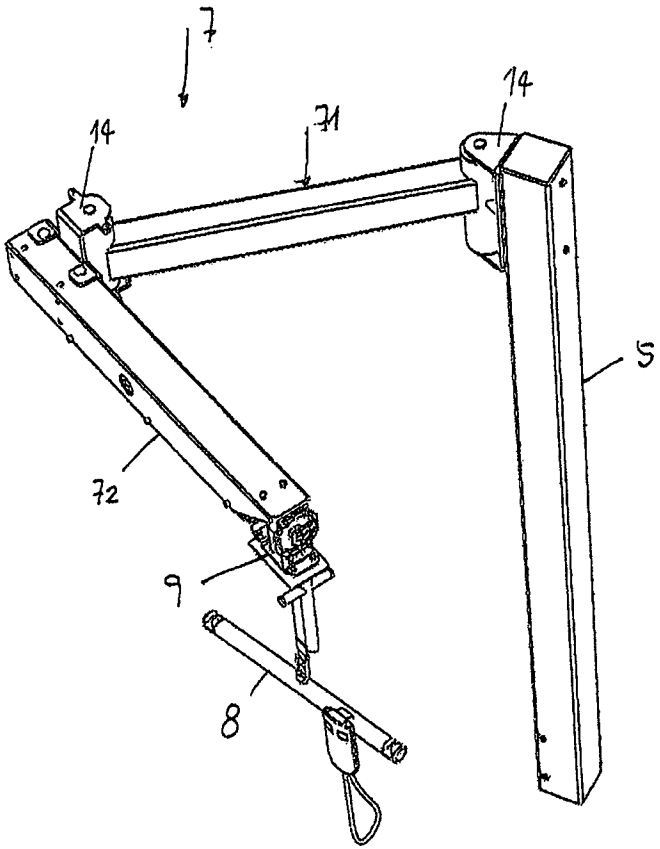

The vertical arm 5, at its upper end, is connected via a rotatable device 14 (see FIG. 1*c*) to a horizontal arm 7 (see also FIG. 3*b*). The horizontal arm 7 comprises two sub-arms 71, 72 which are pivotally or rotatably connected to each other. One of the sub-arms 71 of the horizontal arm 7 will in a suitable manner be connected to the vertical arm 5, whilst the other sub-arm 72 is connected to the inside of the horizontally disposed cabinet 4. When the system 1 is in use, the arm 7 of the patient lifting apparatus that is pivotal in a horizontal plane will follow the movement of the horizontal cabinet 4, whereby the patient lifting apparatus can be brought from a stowed-away and secured position to a position of use in one and the same integrated movement.

The vertical arm 5 and the arm 7 that is pivotal in a horizontal plane are connected to each other through a hinge means 14. The sub-arm 71 will then at each of its ends comprise a bearing housing, which bearing housing, for example, may be welded onto the sub-arm 71. The sub-arm 71 will then be connected to the vertical arm 5 and the sub-arm 72 via a mounting bracket. The bearing housing and the mounting bracket are further configured with complementary through holes, whereby a shaft or a bolt will connect the bearing housing and the mounting bracket.

In connection with sub-arm 72, which is arranged in the horizontal cabinet 4, and the cabinet 4 there is also provided a removable lifting bar 8 (see also FIG. 1*c*), which lifting bar 8 is used when a bedridden person or a mobility impaired person H is raised/lowered and/or moved. The lifting bar 8 is connected via at least a wire 12 or the like to a remote controlled drive unit 9 (see FIG. 3*b*), which drive unit 9 is also arranged in the horizontal overhead cabinet 4, either by being connected to the sub-arm 72 or also internally to the horizontal overhead cabinet 4. The horizontal overhead cabinet 4 will then be configured with a recess (see FIG. 1*c*) for entry of the drive unit 9. The drive unit 9 is controlled by a controller 13.

The drive unit 9 is constituted of a motor, gear and motor brake, which are connected directly to a drum (not shown). The drive unit 9 is further connected permanently to the mains supply. A power cable (not shown), that is connected to the drive unit is passed along the arm 7 that is pivotal in the horizontal plane and the vertical arm 5, whereafter it is connected to the mains supply. The drive unit comprises one or more "backup" batteries (not shown), which will automatically supply power in the event of a power failure etc.

When the system for handling and moving bedridden patients or mobility impaired persons 1 is in its stowed-away and secured position, the sub-arms 71, 72 will be arranged lying parallel above or at the side of each other. The horizontally disposed overhead cabinet 4 will then house the arm 7 that is pivotal in a horizontal plane, thus concealing it.

In FIG. 1*b* a person P, for example, a caregiver, is in the process of arranging a lifting sling S under a bedridden patient or a mobility impaired person H. The lifting sling S, the lifting bar 8 and other equipment are arranged in the vertical cabinet 2, such that they are readily accessible. This may be done, for example, by providing hooks, shelves etc. (not shown) internally in the vertical cabinet 2. The fact that the lifting sling S, the lifting bar 8 and other equipment have an easily accessible, permanent location also helps to prevent this loose equipment from going astray or being mislaid when the system 1 is not in use.

In FIG. 1*c* the person P has arranged the lifting sling S under the bedridden patient or the mobility impaired person H, whereby the patient or the mobility impaired person H is ready to be lifted and/or moved. So-called lifting lugs 12 in the lifting sling S will then be connected to the lifting bar 8, this being accomplished by turning the horizontal overhead cabinet 4 out from the wall. One of the sub-arms 72 of the horizontal arm 7, since it is fastened internally in the horizontal overhead cabinet 4, will then follow the movement of the horizontal overhead cabinet 4. With the aid of the other sub-arm 71 of the horizontal arm 7, the lifting bar 8 can then be positioned correctly above the patient or the mobility impaired person H. The person P will subsequently operate the drive unit 9, so that the lifting bar 8 is lowered towards the bedridden patient or the mobility impaired person H. After the lifting sling S has been fastened to the lifting hook 8, the person P will again operate the drive unit 9, so that the patient or person H is lifted up from the bed B. The patient or person H is now ready to be moved towards a chair C.

In FIG. 1*d* the bedridden patient or the mobility impaired person H has been moved to a position above the chair C, whereupon the person P will again operate the drive unit 9 in order to lower the patient or person H into the chair C. The sub-arms 71, 72 of the horizontal arm 7 are then turned further out from the wall, the outermost sub-arm 72 being used to "finely position" the patient H above the chair C.

Figure 2A:
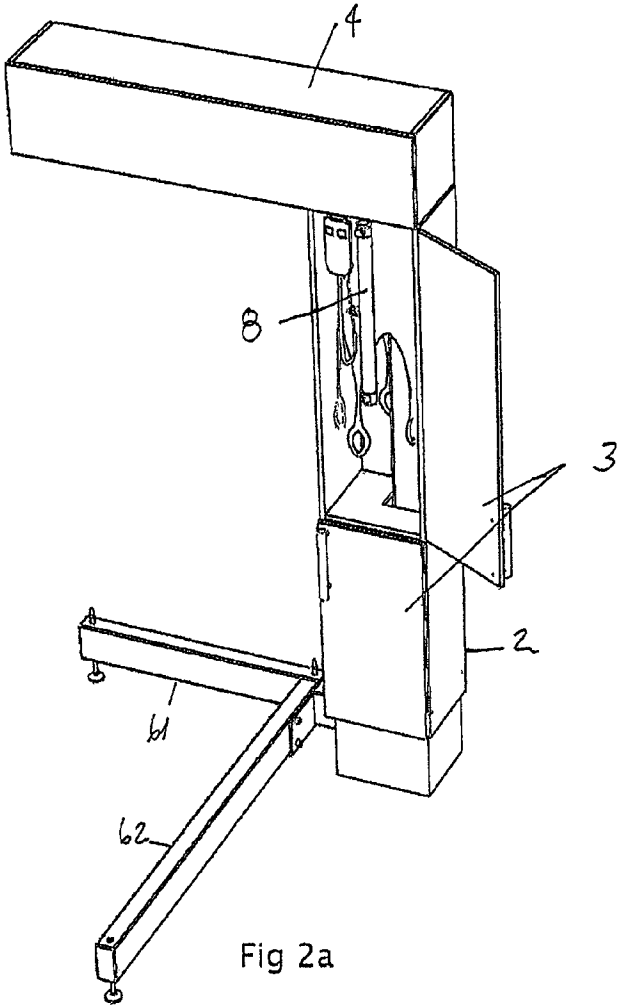
FIGS. 2*a-b* show an alternative embodiment of the system for handling and moving bedridden patients or mobility impaired persons.
Figure 2B:
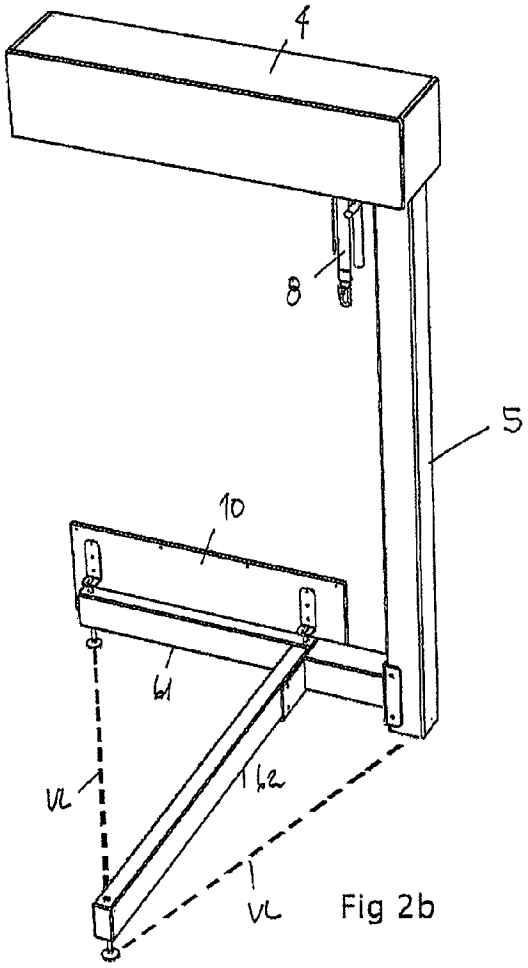

FIGS. 2*a-b* show a second embodiment of the system for handling and moving a bedridden patient or a mobility impaired person 1 according to the present invention, where one set of support legs 61, 62 is connected to the vertical arm 5 and/or the wall/floor. Thus, the patient lifting apparatus 1 in some load positions, for example, when the patient lifting apparatus is in such a position that the vertical projection of the load on the floor is within tilt lines VL which are defined by legs 61 and 62, will be "supported" only by legs 61 and 62. In other load positions, when the patient lifting apparatus is in such a position that the vertical projection of the load on the floor is outside the tilt lines VL which are defined by legs 61, 62, the patient lifting apparatus is "supported" both by legs 61, 62 and by the mounting that is used to fasten the legs 61, 62 to a wall and/or floor.

In FIG. 2*a* the support legs 61, 62 are firmly connected to the lower end of the vertical arm 5 (see also FIG. 2*b*), whilst the support legs 61, 62 are rotatably connected to each other. The support leg 61, 62, in a retracted position of the system 1, or when the patient lifting apparatus is subjected to a smallish load, will be arranged parallel to the wall. If a heavier lift is to be carried out using the patient lifting apparatus, for example, that the bedridden patient or the mobility impaired person H is heavier and/or that the lift or moving takes place further out from the wall, the support leg 62 can be turned out from the wall and into a position which is essentially perpendicular to support leg 61.

In FIG. 2*b* the support leg 61 is with the aid of a mounting bracket 10 fixedly connected to the wall. The support leg 62 is further fixedly connected to the support leg 61, so that the support legs 61, 62, the vertical arm 5 and the wall form a fixed structure.

In FIG. 3*a* the system for handling and moving bedridden patients or mobility impaired persons 1 is shown in greater detail, the vertical cabinet 2 having been removed and the horizontally disposed overhead cabinet 4 having been drawn out from the wall, so that the articulated arm 7, consisting of arm member 71 and arm member 72, is shown in part. The arm member 72 is covered or concealed by the horizontally arranged overhead cabinet 4. The lifting bar 8 is connected via a wire or a cable to the drive unit 9, which drive unit 9 is also concealed by the overhead cabinet 4. A remote control 11 for drive unit 9 is hooked onto the lifting bar 8.

In FIG. 3*b* the horizontally arranged overhead cabinet 4 has also been removed, so that the whole of the articulated arm 7, with arm members 71, 72 is shown.

The invention has now been explained with the aid of several non-limiting exemplary embodiments. A person of skill in the art will understand that a number of variations and modifications can be made to the system for handling and moving bedridden patients and/or mobility impaired persons as described within the scope of the invention as defined in the appended claims.

The invention claimed is:

1. A system for handling and moving bedridden or mobility impaired persons, the system comprising:

a vertical arm and a second arm pivotal in a horizontal plane, the vertical arm and the second arm being connected through a pivot connection, the vertical arm being arranged in at least a vertically disposed cabinet, the second arm including a first member and a second member, the first and second members being connected to each other, the second arm further being arranged in and connected to a horizontally disposed overhead cabinet, in such a way that the horizontally disposed overhead cabinet follows the movement of one of the first member and the second member.

2. The system according to claim 1, wherein the vertical arm is connected to at least one of a wall, a ceiling and floor.

3. The system according to claim 1, wherein the vertical arm comprises one support leg.

4. The system according to claim 3, wherein the one support leg is pivotally connected to the vertical arm.

5. The system according to claim 1, wherein the first and second members via a joint are pivotally connected to each other.

6. The system according to claim 1, wherein one of the first and second members of the second arm that is pivotal in the horizontal plane are telescopic.

7. The system according to claim 1, wherein a drive unit is connected to the second arm that is pivotal in a horizontal plane.

8. The system according to claim 7, wherein a removable lifting bar is connected to the drive unit.

9. The system according to claim 8, wherein the drive unit is controlled by way of a controller.

10. The system according to claim 1, wherein the system is manually or remotely-control operated.

11. The system according to claim 1, wherein, in the vertical cabinet there are arranged units for storing equipment.

12. The system according to claim 1, wherein the horizontal overhead cabinet is configured with a recess for entry of a drive unit.

13. The system according to claim 8, wherein a removable lifting bar is connected via a wire to the drive unit.

14. The system according to claim 2, wherein the vertical arm comprises one support leg.

15. The system according to claim 14, wherein the one support leg is pivotally connected to the vertical arm.

16. The system according to claim 5, wherein one of the first and second members of the second arm that is pivotal in the horizontal plane are telescopic.

17. The system according to claim 5, wherein a drive unit is connected to the second arm that is pivotal in a horizontal plane.

18. The system according to claim 1, wherein the first member and the second member of the second arm are pivotally or rotatably connected to each other.

19. The system according to claim 1, wherein one end of the first member of the second arm is connected to the vertical arm, and one end of the second member of the second arm is connected to the inside of the horizontally disposed overhead.

20. The system according to claim 1, wherein the first and second members are configured to be turned further out from a wall, whereby the second member is used to finely position the system.

* * * * *